US006215205B1

(12) United States Patent
Banas et al.

(10) Patent No.: US 6,215,205 B1
(45) Date of Patent: Apr. 10, 2001

(54) ADJUSTABLE LENGTH CONVEYOR SYSTEM

(75) Inventors: Mark Daniel Banas, Cuyahoga Falls; Klaus Beer, Stow; Gary Robert Burg, Canton; Kenneth Dean Conger; Raymond Patrick Eckman, both of Stow; Dennis Alan Lundell, North Canton; Ralph Damon Ring, Akron; John Patrick Roman, Cuyahoga Falls; James Dale Stokes; Thomas Alan Murray, both of Akron, all of OH (US)

(73) Assignee: The Goodyear Tire & Rubber Company, Akron, OH (US)

( * ) Notice: Subject to any disclaimer, the term of this patent is extended or adjusted under 35 U.S.C. 154(b) by 0 days.

(21) Appl. No.: 09/171,927

(22) PCT Filed: Aug. 6, 1996

(86) PCT No.: PCT/US96/12932

§ 371 Date: Oct. 26, 1998

§ 102(e) Date: Oct. 26, 1998

(87) PCT Pub. No.: WO98/05580

PCT Pub. Date: Feb. 12, 1998

(51) Int. Cl.[7] ..... B29D 30/30; B65H 20/32

(52) U.S. Cl. ..... 310/12; 226/118.2; 226/174

(58) Field of Search ..... 310/12; 318/135; 226/4, 24, 112, 117, 118, 195, 104, 170, 174; 242/535.4

(56) References Cited

U.S. PATENT DOCUMENTS 3,675,868 * 7/1972 Piatelli ..... 242/535.4
4,730,781 * 3/1988 Richter et al. ..... 242/78.8
4,771,991 * 9/1988 Sankaran ..... 266/200
4,892,609 * 1/1990 Nakanome et al. ..... 156/406.4
4,961,813 * 10/1990 Bailey ..... 156/406.4
5,055,149 * 10/1991 Ogawa ..... 156/124
5,271,790 * 12/1993 Nojiri et al. ..... 156/405.1
5,451,011 * 9/1995 Frost et al. ..... 242/552
5,617,985 * 4/1997 Baer ..... 226/4

FOREIGN PATENT DOCUMENTS

3925193 * 2/1991 (DE) .
0 454 094 * 10/1991 (EP) .
0 464 862 * 1/1992 (EP) .

* cited by examiner

*Primary Examiner*—Nestor Ramirez
*Assistant Examiner*—Judson H. Jones
(74) *Attorney, Agent, or Firm*—Frederick K Lacher

(57) ABSTRACT

A conveyor assembly and method for conveying and storing a strip material in a conveyor system that is subject to changes in length of the strip material due to intermittent operation includes an upper conveyor (16), an adjustable substantially horizontal center conveyor (22) for receiving the strip material (34) from the upper conveyor, and a lower conveyor (28) for receiving the associated strip material from the center conveyor. A computer (94) controls the movement and rotation of the center conveyor, and loop detecting apparatus on the center conveyor may also detect a loop (90) in the strip material carried by the center conveyor and thereby detecting changes in length of the strip material not predetermined by the computer. A servomechanism (100) activated by signals from the computer or the loop detecting apparatus moves the center conveyor in a substantially horizontal direction.

21 Claims, 2 Drawing Sheets

ADJUSTABLE LENGTH CONVEYOR SYSTEM

TECHNICAL FIELD

This invention pertains to the art of methods and apparatuses for adjusting the length of a conveyor system to compensate for changes in the length of a strip material caused by intermittent feeding or by changes in speed of feeding, and more specifically to methods and apparatuses for supporting the strip material in a generally horizontal attitude during the length adjustment.

BACKGROUND ART

In the past, vertical festoons were used to adjust the length of a conveyor system to compensate for intermittent feeding of strip material to meet variable production requirements. However, when vertical festoons were used, the strip material was not supported and was stretched by its own weight. This stretching of the strip material was not desirable when assembling a product such as a tire. One such conveyor of strip material is found in U.S. Pat. No. 4,892,609 to Nakanome et al., which discloses an automatic material feeder in tire forming machines. The machine has a traditional vertical festoon to support the buildup of tire building materials.

When conveyors of a strip material did not have features to compensate for changes in length of the strip material caused by intermittent feeding, extruders, for example, would have to be stopped and started to compensate for the changes in feeding. This starting and stopping may produce undesirable variations in the strip material.

Applicants recognized the need to provide an adjustment apparatus and method that did not stretch the strip material and did not produce or add additional stresses to the strip material.

The present invention contemplates a new and improved adjustment for a conveyor system which is simple in design, effective in use, and overcomes the foregoing difficulties and others while providing better and more advantageous overall results.

DISCLOSURE OF INVENTION

In accordance with the present invention, a new and improved adjustable substantially horizontal conveyor is provided which compensates for the changes in length of the strip material being conveyed as a result of intermittent feeding without altering the weight or shape of the strip material.

More particularly, in accordance with the present invention, a conveyor assembly for conveying and storing an associated strip material in a conveyor system is provided. The conveyor assembly includes an upper conveyor for receiving and conveying the associated strip material. The upper conveyor has a first conveyor belt and a first driving means for driving the first conveyor belt. The upper conveyor is substantially stationary. A center conveyor receives the associated strip material from the upper conveyor, and has a second conveyor belt and a second driving means for driving the second conveyor belt. The center conveyor is movable along a substantially horizontal path and has length adjusting means for moving the center conveyor along the path. A lower conveyor is provided for receiving the associated strip material from the center conveyor, and has a third conveyor belt with a third driving means for driving the third conveyor belt. The lower conveyor is substantially stationary.

According to one aspect of the present invention there is provided a length adjusting conveyor for storing a variable length of strip material in a conveyor system including supply means for supplying the associated strip material to the length adjusting conveyor with the length adjusting conveyor having a conveyor belt and driving means for driving the conveyor belt, the length adjusting conveyor being movable along a substantially horizontal path; power means for moving the length adjusting conveyor along the path; and, take away means for receiving the associated strip material from the length adjusting conveyor.

According to another aspect of the present invention there is provided a method of conveying an associated strip material along a conveyor assembly wherein the conveyor assembly includes an upper conveyor having a first conveyor belt and a first driving means, a center length adjusting conveyor having a second conveyor belt and a second driving means, and a lower conveyor having a third conveyor belt and third driving means, the method including the steps of: conveying the associated strip material along the upper conveyor in a first direction with the first driving means; transferring the associated strip material to the center length adjusting conveyor; moving the center length adjusting conveyor along a substantially horizontal path to adjust the length of the conveyor assembly in response to changes in length of the associated strip material; conveying the associated strip material along the center length adjusting conveyor in a second direction opposite the first direction with the second driving means; transferring the associated strip material to the lower conveyor; and, conveying the associated strip material along the lower conveyor in the first direction with the third driving means.

According to another aspect of the present invention there is provided a method of adjusting the length of a conveyor system to compensate for changes in the length of an associated strip in a conveyor system, the conveyor system having a length adjusting conveyor with a conveyor belt and driving means, supply means, and take away means, the method including the steps of: supplying the associated strip material to the length adjusting conveyor with the supply means; moving the length adjusting conveyor in a substantially horizontal direction in response to changes in length of the associated strip material in the conveyor system; conveying the associated strip material along at least a portion of the length adjusting conveyor with the driving means; and, transferring the associated strip material to the take away means.

One advantage of the present invention is that the conveyor system may adjust for variable lengths of the strip material in the system caused by different supply and take away speeds including stoppage at the takeaway position.

Another advantage of the present invention is that the conveyor system adjusts for changes in the length of the strip material in the system without changing the stresses on the strip material.

Still other benefits and advantages of the invention will become apparent to those skilled in the art to which it pertains upon a reading and understanding of the following detailed specification.

BRIEF DESCRIPTION OF DRAWINGS

The invention may take physical form in certain parts and arrangement of parts, a preferred embodiment of which will be described in detail in this specification and illustrated in the accompanying drawings which form a part hereof and herein.

DETAILED DESCRIPTION OF THE INVENTION

Figure 1:
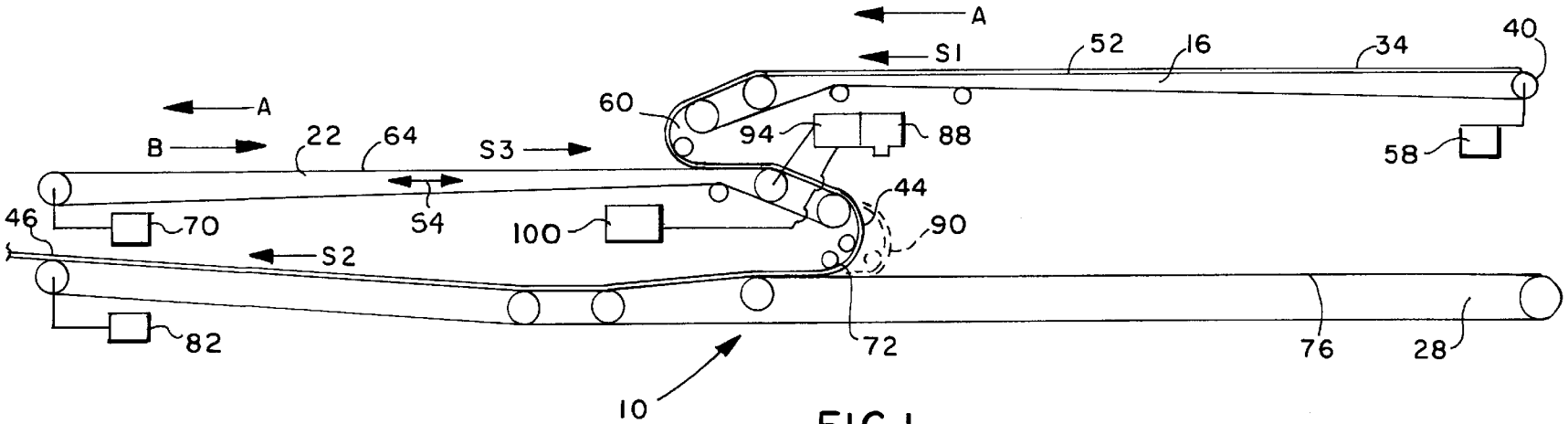
FIG. 1 is a schematic side elevation of a conveyor assembly embodying the invention showing the center conveyor in the retracted position.

Referring now to the drawings wherein the showings are for purposes of illustrating a preferred embodiment of the invention only and not for purposes of limiting the same, FIG. 1 shows a schematic view of a conveyor assembly 10 embodying the system of the invention. The conveyor assembly 10 preferably has an upper conveyor 16, a center conveyor 22, and a lower conveyor 28. A strip material 34 of rubber or other deformable material is conveyed by the conveyor assembly 10 from a supply position 40, such as from an extruder, along a path 44 to a take away position 46, for feeding the strip material to apparatus such as a strip applicator. The strip material 34 is conveyed from the supply position 40 over the upper conveyor 16 in the direction of arrow A by a conveyor belt 52 driven by a first servomotor 58. The strip material to fall over an end 60 of the upper conveyor 16 onto the center conveyor where the strip material is moved in a reverse direction as shown by arrow B. The strip material 34 is turned over and is conveyed on the center conveyor 22 on a conveyor belt 64 driven by a second servomotor 70. At a leading end 72 of the center conveyor 22, the strip material 34 is then transferred to the lower conveyor 28, preferably by allowing the strip material to fall over the end of the center conveyor onto the lower conveyor where the strip material again reverses direction in the direction of arrow A and is turned over to the same position as it was on the upper conveyor 16 so that it is right side up. The lower conveyor 28 conveys the strip material 34 in the direction of arrow A along a conveyor belt 76 driven by a third servomotor 82 to the take away position 46.

The upper conveyor 16 conveys the strip material 34 at an upper conveyor speed S1 that equals the speed at which strip material is provided at the supply position 40. The lower conveyor 28 conveys strip material 34 at a lower conveyor speed S2 that equals the speed at which the strip material is taken away at the take away position 46. When speed S1 equals speed S2, the center conveyor 22 conveys strip material 34 at a speed S3 that is equal to speed S1 and speed S2. When the demand for the strip material 34 at the take away position 46 decreases, such as when the feeding of the strip material application is intermittent, or decreased, the speed S2 is decreased. If speed S1 of the upper conveyor 16 cannot be adjusted to compensate for the decrease in speed S2, then the strip material 34 will back up along the conveyor assembly 10. In the preferred embodiment of the invention, a computer 94 is used to control the servomotor 70 that drives the center conveyor belt 64. The center conveyor 22 may be supported on a frame which is mounted on a servomechanism 100 such as a belt driven liner actuator having a servo motor to move the frame and supported center conveyor back and forth substantially horizontally, in the directions of arrows A and B. If the speed S1 is different than the sped S2, then computer 94 preferably directs servomotor 70 to rotate the center conveyor belt 64 at a speed S3 that is equal to the average of speeds S1 and S2 or one half of the sum of speeds S1 and S2. Computer 94 is also connected to the servomechanism 100 which moves the center conveyor 22 at a speed S4 that is equal to one half of the difference between speed S3 and speed S2. If speed S3 is greater than speed S2, the center conveyor 22 is moved in the direction of arrow B. If speed S2 is greater than the speed S3, then the center conveyor 22 is moved in the direction of arrow A. The speed S4 at which the center conveyor 22 is moved is predetermined for the condition where S2 is zero between feeding of the strip material 34 and where S2 is greater than S1, during the feeding of the strip material. Additionally, an optical sensor 88 is placed near the end 72 of the center conveyor 22 to detect whether a loop 90, shown in dotted lines, is formed by decreased tension in the strip material 34 due to the speed S2 of the lower conveyor 28 being less than the speed S1 of the upper conveyor, and when the computer 94 has not made a correction for the decreased tension in the strip material. If such a loop 90 is detected the computer 94 receives a signal from the optical sensor 88 and in response causes the servomechanism 100 to move the center conveyor 22 for a predetermined time in direction B to adjust the length of the strip material 34 by picking up the slack in the strip material.

Figure 2:
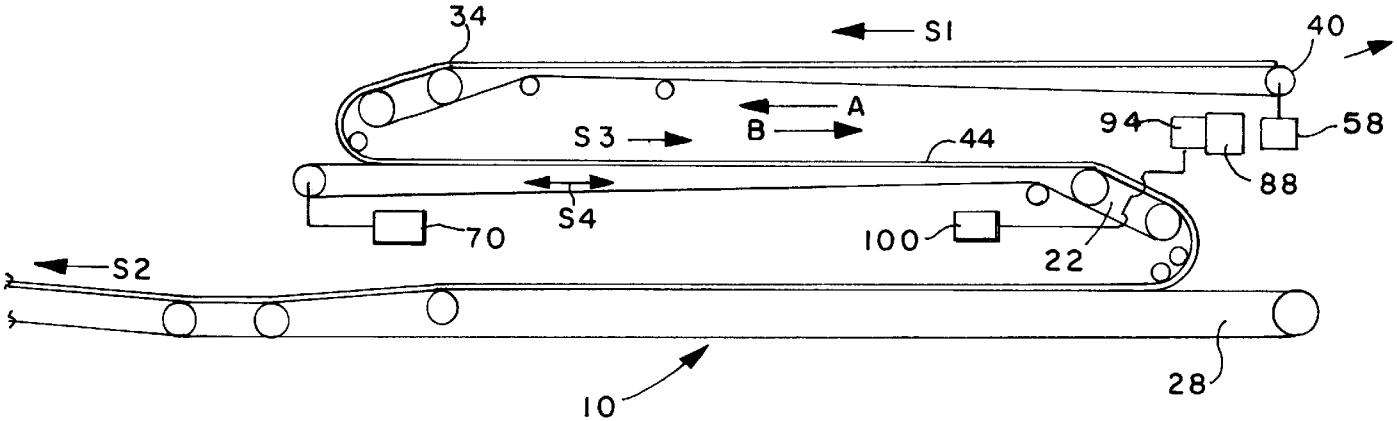
FIG. 2 is a schematic side elevation of the conveyor assembly of FIG. 1 with the center conveyor in the extended position.

FIG. 2 shows a schematic view of the conveyor assembly 10 with the center conveyor 22 moved to the right and acting as a length adjusting conveyor by increasing the length of the path 44 to accommodate the increased length of the strip material 34 in the system as the strip material is moved along the conveyor assembly 10. In FIG. 2, the servomechanism 100 has moved the center conveyor 22 in the direction of arrow B at the direction of the computer 94 or after the sensor 88 detected a loop 90. This movement has increased the length of the path 44 to compensate for the increased length of the strip material 34 in the system and allows the conveyor assembly 10 to support the strip material without increasing the tension in the strip material. This is particularly important for materials such as extruded rubber that are susceptible to deformation under tension.

With further reference to FIGS. 1 and 2, when a loop 90 is detected by the optical sensor 88 which is in communication with the computer 94, signals are conveyed from the computer to the servomechanism 100 preferably to move the center conveyor 22 at a speed S4 that is one half the difference between speed S3 and speed S2. The center conveyor 22 is moved in the direction of arrow B if speed S2 is less than speed S3, and the center conveyor is moved in the direction of arrow A if speed S2 is greater than speed S3. When the sensor 88 no longer detects a loop 90 in the strip material 34, the computer 94 conveys signals to servomechanism 100 to move the center conveyor 22 in the direction of arrow A. If a loop 90 is again detected in the strip material 34 by the sensor 88, the computer 94 will once again convey signals to the servomechanism 100 to move the center conveyor in the direction of arrow B. This process of moving the center conveyor 22 back and forth keeps the conveyor assembly 10 in an equilibrium position and the tension on the strip material 34 substantially constant.

Figure 3:
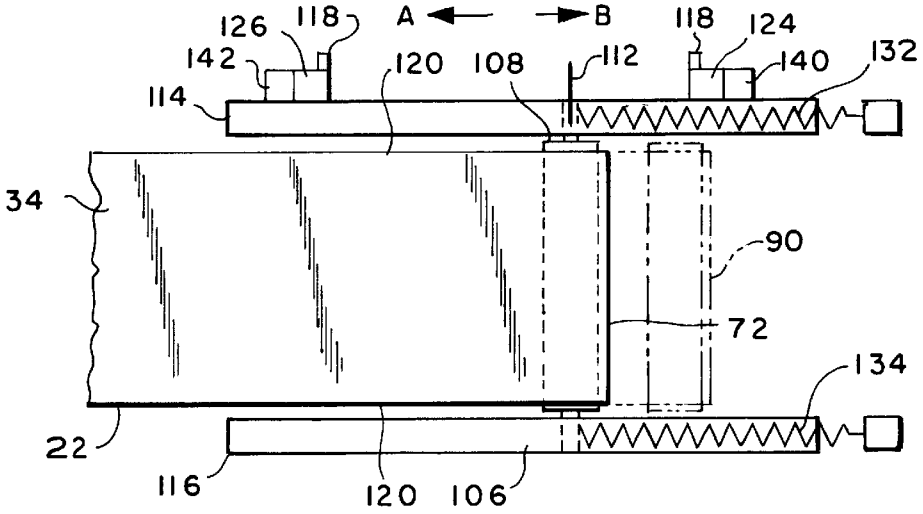
FIG. 3 is an enlarged fragmentary view of part of the center conveyor showing a preferred embodiment of the present invention utilizing a proximity switch; and, FIG. 4 is a schematic side elevation of the conveyor assembly of FIG. 1 with a proximity switch at the end of the center conveyor and the upper conveyor.

With reference to FIG. 3, a preferred embodiment of the sensor for the loop 90 is shown in which a proximity switch 106 is disposed at the end 72 of the center conveyor 22 to detect the loop in the strip material 34. The proximity switch 106 includes a roller 108 attached to a metal contact 112. The roller 108 is guided by slides 114, 116 located at the sides 120, 122 of the center conveyor 22. The roller 108 is pulled in direction A by the tension of the strip material 34, and in direction B by springs 132, 134 that are connected to the roller. The metal contact 112 moves back and forth between two contacts 124, 126 to form a switch. When speed S1 is equal to speed S2, the proximity switch 106 is held in an equilibrium position, and the metal contact is suspended between the two contacts, 124, 126. When the speed S1 is greater than speed S2, a loop 90 forms around the proximity switch 106, and the tension on the roller 108 is reduced, thereby allowing springs 132, 134 to pull the roller and the metal contact 112 into engagement with contact 124, and thereby closing a circuit that includes the power supply 118 and detection apparatus 140. The detection apparatus 140 then causes activation of the servomechanism 100 (see FIG. 2) to move the center conveyor 22 at a speed S4 equal to one half the difference of speeds S3 and S2 to adjust the path 44 of the strip material 34 by increasing the length of the path of the strip material. If speed S2 is greater than speed S1, then a greater amount of tension is placed on the roller 108. The tension on the roller 108 overcomes the pull of springs 132, 134 and the metal contact 112 comes into engagement with contact 126, thereby closing a circuit that includes the power supply 118 and detection apparatus 142. The detection apparatus 142 then causes activation of the servomechanism 100 (see FIG. 2) to move the center conveyor 22 at a speed S4 equal to one half the difference between speeds S3 and S2 in direction A as shown in FIG. 2 to release strip material 34 taken up by prior movement of the center conveyor and thereby decrease the length of the path 44 of the strip material.

Figure 4:
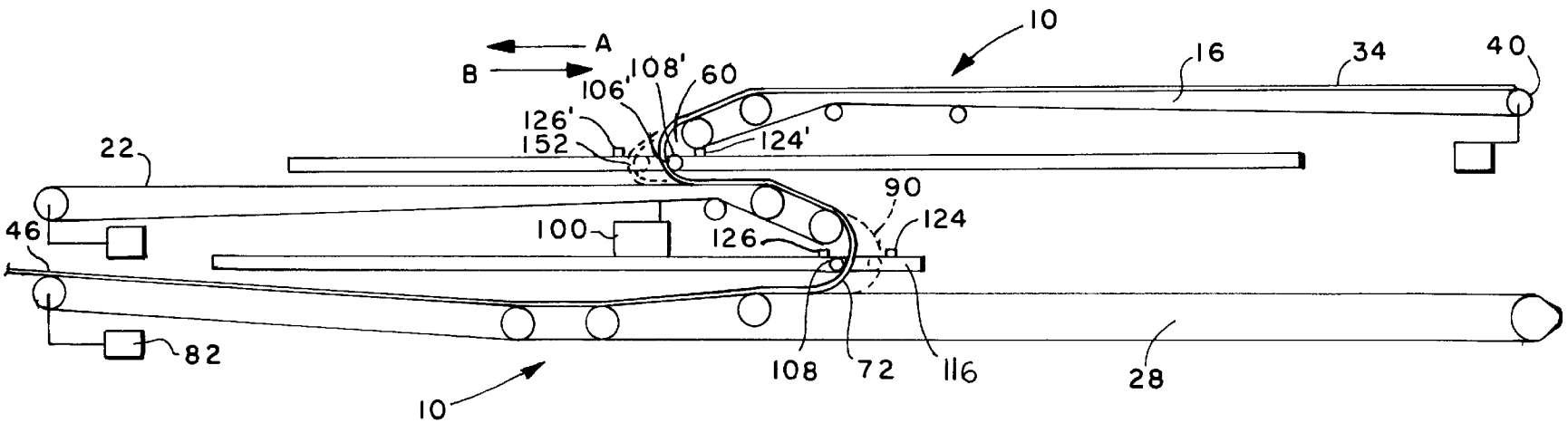

With reference to FIG. 4, a conveyor assembly 10 is shown with the proximity switch 106 at the end 72 of the center conveyor 22. Additionally, a second proximity switch 106' is located at the end 60 of the upper conveyor 16. The second proximity switch 106' further enables the conveyor assembly 10 to detect changes in tension in the strip material 34 by detecting a loop 152 that forms around the end 60 of the upper conveyor 16. The second proximity switch 106' has a roller 108', contacts 124' and 126' and is also connected to the servomechanism 100 that controls the speed S4 of the center conveyor 22.

With continuing reference to FIGS. 1, 2, 3, and 4, the conveyor assembly 10 may employ more than one center conveyor 22 to increase the capacity of the conveyor assembly to accommodate changes in the length of the strip material 34 caused by intermittent feeding of strip material at the takeaway position 46. Each center conveyor 22 may be equipped with either an optical sensor 88 or proximity switch 106 to detect a loop 90 in the strip material 34 at the end of the center conveyor. The strip material 34 may also be fed through the conveyor assembly 10 to a supply position 40 along the path 44 in the direction opposite that described heretofore. A computer may be connected to the servomechanisms 100 of the center conveyors 22 for controlling their movement during intermittent operation of the lower conveyor 28.

While certain representative embodiments and details have been shown for the purpose of illustrating the invention, it will be apparent to those skilled in the art that various changes and modifications may be made therein without departing from the scope of the invention.

Having thus described the invention, it is now claimed:

1. A conveyor assembly for conveying and storing an associated strip material in a conveyor system, said conveyor assembly comprising:

an upper conveyor for receiving and conveying said associated strip material, said upper conveyor having a first conveyor belt and a first driving means for driving said first conveyor belt, said upper conveyor being substantially stationary, characterized by:

a center conveyor for receiving said associated strip material from said upper conveyor, said center conveyor having a second conveyor belt and a second driving means for driving said second conveyor belt, said center conveyor being movable along a substantially horizontal path;

length adjusting means for moving said center conveyor along said path; and, a lower conveyor for receiving said associated strip material from said center conveyor, said lower conveyor having a third conveyor belt and a third driving means for driving said third conveyor belt, said lower conveyor being substantially stationary.

2. The conveyor assembly of claim 1 wherein said length adjusting means is further characterized by:

loop detecting means for detecting loops in said associated strip material carried by said center conveyor; and, a servomechanism for moving said center conveyor along said path in response to signals from said loop detecting means.

3. The conveyor assembly of claim 2 further characterized by said loop detecting means having a proximity switch at a leading edge of said center conveyor for contacting said associated strip material, said proximity switch comprising:

a roller for contacting said associated strip material;

a slide for guiding movement of said roller into engagement with said strip material;

a switch having a first switch contact and a second switch contact;

a metal contact connected to and movable with said roller for closing a first circuit when contacting said first switch contact and thereby activate said servomechanism to move said center conveyor in a first direction and said metal contact being movable to close a second circuit when contacting said second switch contact and thereby activate said servomechanism to move said center conveyor in a second direction, said first and second circuits being connected to said servomechanism;

at least one spring urging said roller and said metal contact towards said first switch contact and against aid strip material for urging said roller and said metal contact towards said second switch contact, said metal contact contacting said first switch contact and activating said first circuit when the force applied by said associated strip material on said roller fails to urge said roller to overcome said at least one spring and allows said metal contact to contact said first switch contact, said metal contact contacting said second switch contact and activating said second circuit when said at least one spring fails to overcome said strip material.

4. The conveyor assembly of claim 3 further characterized by said loop detecting means having a second proximity switch located at a leading edge of said upper conveyor.

5. The conveyor assembly of claim 2 further characterized by said loop detecting means having a sensor for detecting loops in said associated strip material; and, control means connected to said sensor for controlling said center conveyor.

6. The conveyor assembly of claim 1 further characterized by said first driving means being a servomotor.

7. The conveyor assembly of claim 1 further characterized by said second driving means being a servomotor.

8. The conveyor assembly of claim 1 further characterized by said third driving means being a servomotor.

9. A length adjusting conveyor for storing an associated strip material in a conveyor system wherein supply means supply said associated strip material to said length adjusting conveyor and take away means receive said associated strip material from said length adjusting conveyor characterized by said length adjusting conveyor having a conveyor belt, driving means for driving said conveyor belt with said conveyor being movable along a substantially horizontal path, and power means for moving said length adjusting conveyor along said path.

10. The length adjusting conveyor of claim 9 further characterized by loop detecting means for detecting a loop in said associated strip material and a servomechanism for moving said length adjusting conveyor along said path in response to changes in said loop.

11. The length adjusting conveyor of claim 10 further characterized by said loop detecting means including a proximity switch at a leading edge of said length adjusting conveyor for contacting said associated strip material, said proximity switch comprising:

a roller for contacting said associated strip material;

a slide for guiding said roller;

a switch having a first switch contact and a second switch contact;

a metal contact extending away from said roller for said metal contact closing a first circuit when contacting said first switch contact and thereby activating said servomechanism to move said length adjusting conveyor in a first direction, said metal contact closing a second circuit when contacting said second switch contact and thereby activating said servomechanism to move said length adjusting conveyor in a second direction, said first and second circuits being connected to said servomechanism;

at least one spring for urging said roller and said metal contact towards said first switch contact, said strip material urging said roller and said metal contact towards said second switch contact, said metal contact contacting said first switch contact and activating said first circuit when said associated strip material fails to urge said roller to overcome said at least one spring and allows said metal contact to contact said first switch contact, said metal contact contacting said second switch contact and activating said second circuit when said at least one spring fails to overcome said strip material.

12. The length adjusting conveyor of claim 10 wherein said loop detecting means is further characterized by a sensor for detecting a loop in said associated strip material and connected to control means for controlling the position of said length adjusting conveyor in response to said loop detected by said sensor.

13. The length adjusting conveyor of claim 9 further characterized by said driving means being a servomotor.

14. A method of conveying an associated strip material along a conveyor assembly having an upper conveyor with a first conveyor belt and a first driving means, a movable center length adjusting conveyor having a second conveyor belt and second driving means, and a lower conveyor having a third conveyor belt and third driving means, said method characterized by the steps of:

conveying said associated strip material along said upper conveyor in a first direction with said first driving means;

transferring said associated strip material to said center length adjusting conveyor;

moving said center length adjusting conveyor along a substantially horizontal path to adjust the length of said conveyor assembly in response to changes in length of said associated strip material in said conveyor assembly;

conveying said associated strip material along said center length adjusting conveyor in a second direction opposite said first direction with said second driving means;

transferring said associated strip material to said lower conveyor; and, conveying said associated strip material along said lower conveyor in said first direction with said third driving means.

15. The method of claim 14 wherein said conveyor assembly comprises a loop detection means further characterized by the step of detecting loops in said associated strip material with said loop detection means to detect said changes in length of said associated strip material.

16. The method of claim 14 further characterized by the step of transferring said associated strip material from said upper conveyor to said center length adjusting conveyor by conveying said strip material beyond an end of said upper conveyor whereby said strip material falls to said center length adjusting conveyor.

17. The method of claim 14 further characterized by the step of transferring said associated strip material from said center length adjusting conveyor to said lower conveyor by conveying said strip material beyond an end of said center length adjusting conveyor whereby said strip material falls to said lower conveyor.

18. A method of adjusting the length of a conveyor system to compensate for changes in the length of an associated strip in a conveyor system, said conveyor system having a length adjusting conveyor with a conveyor belt and driving means, supply means, and take away means, said method characterized by the steps of:

supplying said associated strip material to said length adjusting conveyor from said supply means;

moving said length adjusting conveyor in a substantially horizontal direction in response to changes in length of said associated strip material in said conveyor system;

conveying said associated strip material along at least a portion of said length adjusting conveyor with said driving means; and, transferring said associated strip material to said take away means.

19. The method of claim 18 wherein said conveyor system has a loop detection means, further characterized by detecting loops in said associated strip material with said loop detection means for detecting said changes in length of said associated strip material.

20. The method of claim 18 wherein said conveyor system has control means further characterized by predetermining the adjusting movement of said length adjusting conveyor by said control means in response to said changes in length of said strip material.

21. The method of claim 20 wherein said conveyor system has a loop detection means further characterized by said control means being actuated to change said adjusting movement of said length adjustor conveyor in response to detection of a loop by said loop detection means.

* * * * *